US008320815B2

(12) United States Patent
Yano et al.

(10) Patent No.: US 8,320,815 B2
(45) Date of Patent: Nov. 27, 2012

(54) IMAGE FORMING DEVICE CONFIGURED TO CONTROL A CARRYING SPEED OF A RECORDING MEDIUM

(75) Inventors: Hidetoshi Yano, Aichi (JP); Sachiko Yano, Tokai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 701 days.

(21) Appl. No.: 12/324,173

(22) Filed: Nov. 26, 2008

(65) Prior Publication Data

US 2009/0180822 A1 Jul. 16, 2009

(30) Foreign Application Priority Data

Nov. 26, 2007 (JP) ..... 2007-304054

(51) Int. Cl.
*G03G 15/00* (2006.01)
*B65H 3/44* (2006.01)

(52) U.S. Cl. ..... 399/392; 399/388; 399/391; 399/393; 399/396; 271/9.01; 271/9.09; 271/9.13

(58) Field of Classification Search ..... 399/388, 399/391, 392, 393, 396; 271/3.15, 9.01, 271/9.09, 9.13, 270
See application file for complete search history.

(56) References Cited

U.S. PATENT DOCUMENTS 5,221,949 A * 6/1993 Miyamoto ..... 399/389
6,608,991 B2 * 8/2003 Takada ..... 399/394
6,644,652 B1 * 11/2003 Walsh et al. ..... 271/186
6,947,701 B2 * 9/2005 Uchida et al. ..... 399/401
7,237,772 B2 * 7/2007 Kamamura ..... 271/9.01
7,506,866 B2 * 3/2009 Igarashi ..... 271/10.1
2006/0002735 A1 1/2006 Tamaru et al.
2006/0067732 A1 3/2006 Igarashi
2006/0079358 A1 4/2006 Igarashi
2006/0180973 A1 8/2006 Igarashi
2006/0193666 A1 8/2006 Tomatsu

FOREIGN PATENT DOCUMENTS

JP 4-365740 A 12/1992
JP 5-238607 A 9/1993
JP 5-297657 A 11/1993
JP 5-323776 A 12/1993

(Continued)

OTHER PUBLICATIONS

JP Office Action dtd Sep. 9, 2009, JP Appln. 2007-304054, English translation.

*Primary Examiner* — Judy Nguyen
*Assistant Examiner* — Justin Olamit
(74) *Attorney, Agent, or Firm* — Banner & Witcoff, Ltd.

(57) ABSTRACT

An image forming device includes a plurality of medium feed units configured to feed a recording medium on respective carrying routes, an image forming unit configured to form an image on the recording medium fed from one of the plurality of medium feed units, a first roller provided on a common route of the carrying routes, the first roller being configured to rotate at a first circumferential velocity and carry, to the image forming unit, the recording medium fed from one of the plurality of medium feed units, and a control unit configured to control the first circumferential velocity of the first roller depending on from which of the plurality of medium feed units the recording medium is fed.

11 Claims, 5 Drawing Sheets

FOREIGN PATENT DOCUMENTS

| | | | |
|---|---|---|---|
| JP | 5-333632 | A | 12/1993 |
| JP | 7-157109 | A | 6/1995 |
| JP | 9-204083 | A | 8/1997 |
| JP | 2001-341890 | A | 12/2001 |
| JP | 2006-096527 | A | 4/2006 |
| JP | 2006-240765 | A | 9/2006 |

* cited by examiner

IMAGE FORMING DEVICE CONFIGURED TO CONTROL A CARRYING SPEED OF A RECORDING MEDIUM

CROSS-REFERENCE TO RELATED APPLICATION

This application claims priority under 35 U.S.C. §119 from Japanese Patent Application No. 2007-304054 filed on Nov. 26, 2007. The entire subject matter of the application is incorporated herein by reference.

BACKGROUND

1. Technical Field

The following description relates to one or more image forming devices.

2. Related Art

FIG. 5 is a side view schematically showing an entire configuration of a known image forming device with a manual sheet feed device incorporated therein. In the image forming device, a right side in FIG. 5 corresponds to a front face (operation face), on which handles 51 of sheet feed cassettes 12 and 12*a* and a manual sheet feed slot 40 are provided.

A sheet 14 of a normal size fed from the sheet feed cassette 12 or 12*a* by a sheet feed roller 13 is carried by a carrying roller 11, through timing adjustment by a pair of registration rollers 15, toward a transfer portion under a belt photoconductive body 16. A toner image is formed on the photoconductive body with an electrification charger 17, a laser scanning optical system, and a developing unit that are provided around the photoconductive body 16 in an order of a turning direction indicated by an arrow. The toner image formed is transferred onto the sheet 14 due to operation of a transfer charger 20. The toner image transferred on the sheet 14 is fixed by a fixing unit 21. Then, the sheet 14 with the toner image fixed thereon is discharged with a pair of sheet discharge rollers 23 and a switching claw 24 of a sheet discharge unit 22, via sheet discharge guides 25 and 26 and a pair of sheet discharge rollers 27 and 28, from a sheet discharge slot 29 to a stack portion 30 provided on an upper unit with an image-formed surface down, or from a rear sheet discharge slot 31 to a catch tray T with the image-formed surface up.

Further, a sheet loading tray 32 is provided in the vicinity of the manual sheet feed slot 40, and a sheet placed in the sheet loading tray 32 is carried with the carrying roller 11 (for example, see Japanese Patent Provisional Publication No. HE15-238607). In general, rollers provided in a sheet carrying route are adopted such that a roller provided on a further downstream side in a carrying direction carries a sheet at a lower carrying speed. For example, in the aforementioned known image forming device, when a sheet is conveyed from the sheet feed cassette 12 or 12*a*, each roller is adopted such that a circumferential velocity thereof is higher in an order of the sheet feed roller 13, the carrying roller 11, and the pair of registration rollers 15.

This is because a production tolerance is required for manufacturing of each sort of rollers since it is hard to form each sort of rollers in the same shape.

For instance, even though the sheet feed roller 13, the carrying roller 11, and the pair of registration rollers 15 are all designed to rotate at an identical circumferential velocity, the carrying speed for the sheet is not constant due to the production tolerance of each roller. Therefore, a sheet might be carried in a strained state. When a sheet is conveyed in a strained state, a member employed in the carrying route might be damaged and shifted from an appropriate position thereof. To avoid such undesired situations, in general, each roller is adopted such that a roller provided on a further downstream side in the carrying direction carries a sheet at a lower carrying speed. Thereby, a sheet is conveyed in a manner bent between any couple of adjacent rollers in the carrying direction.

SUMMARY

In the aforementioned known image forming device, a sheet fed from the sheet feed cassette 12 or 12*a* is conveyed by the sheet feed roller 13 which rotates at a high circumferential velocity. Hence, a speed difference is caused between carrying speeds for a sheet fed from the sheet feed cassette 12 or 12*a* and a sheet fed manually.

Specifically, the sheet fed from the sheet feed cassette 12 or 12*a* is always pushed toward an upstream side at a high speed by the sheet feed roller 13. Therefore, the carrying roller 11 and/or the pair of registration rollers 15 might slip with respect to the sheet. Thus, the sheet fed from the sheet feed cassette 12 or 12*a* is conveyed at a higher speed than a carrying speed in design to be attained by the carrying roller 11 or the pair of registration rollers 15.

Meanwhile, the sheet fed manually is conveyed by the carrying roller 11 which is rotated in response to a sheet being placed on the sheet loading tray 32. Hence, the sheet is conveyed at a carrying speed in design to be attained by the carrying roller 11. Thereby, there might be a problem that an image transferred position on the sheet fed from the sheet feed cassette 12 or 12*a* and that on the sheet fed manually are different from each other.

Aspects of the present invention are advantageous to provide one or more improved image forming devices that make it possible to always form a consistently-positioned image on a sheet regardless of whether the sheet is fed manually or from a sheet feed cassette.

According to aspects of the present invention, an image forming device is provided, which includes a plurality of medium feed units configured to feed a recording medium on respective carrying routes, an image forming unit configured to form an image on the recording medium fed from one of the plurality of medium feed units, a first roller provided on a common route of the carrying routes, the first roller being configured to rotate at a first circumferential velocity and carry, to the image forming unit, the recording medium fed from one of the plurality of medium feed units, and a control unit configured to control the first circumferential velocity of the first roller depending on from which of the plurality of medium feed units the recording medium is fed.

Further, the control unit may control the first circumferential velocity of the first roller such that the recording medium is carried to the image forming unit at substantially the same carrying speed regardless of the carrying routes.

In some aspects of the present invention, the first circumferential velocity of the first roller, which is provided on the common route of the carrying routes, is controlled depending on from which of the plurality of medium feed units the recording medium is fed. Thereby, it is possible to carry the recording medium to the image forming unit at substantially the same carrying speed and thus form a consistently-positioned image on the recording medium, regardless of the carrying routes.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

Figure 1:
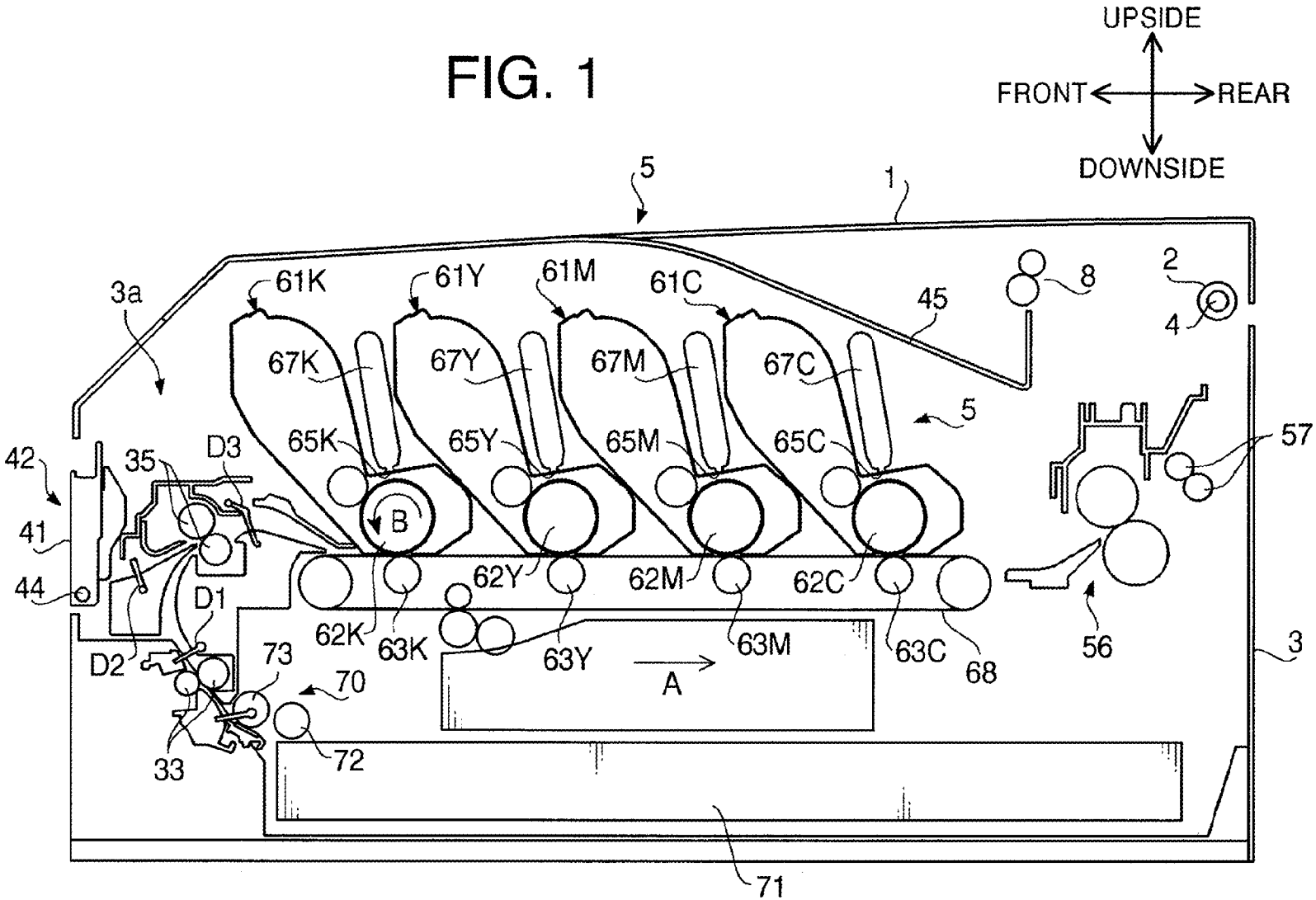
FIG. 1 is a cross-sectional side view schematically showing an entire configuration of an LED printer when an upper case is closed in an embodiment according to one or more aspects of the present invention.

Hereinafter, an embodiment according to aspects of the present invention will be described with reference to the accompanying drawings. FIG. 1 is a cross-sectional side view schematically showing an entire configuration of an LED printer 5 in an embodiment according to aspects of the present invention. In the LED printer 5 shown in FIG. 1, a left side, a right side, a back side, and a front side on the figure are defined as a front side, a rear side, a left side, and a right side, respectively.

1. General Overview of LED Printer

In FIG. 1, an upper case 1 is supported, rotatably with respect to a mechanical unit 3, by a rotational shaft hole 2 provided at a rear side of the upper case 1 and a rotational shaft 4 provided at a rear side of the mechanical unit 3. Further, the mechanical unit 3 has an opening 3*a* at an upper side thereof. It is noted that FIG. 1 shows a state where the upper case 1 is closed with respect to the mechanical unit 3.

As shown in FIG. 1, in the mechanical unit 3 of the LED printer 5, an image forming unit 60 configured to form an image on a recording sheet such as a paper and an OHP transparent sheet and a feeder unit 70 configured to feed a sheet to the image forming unit 60 are incorporated.

Meanwhile, the upper case 1 is provided with a catch tray 45 configured to be loaded with a sheet, on which image formation has been completed, discharged from a discharge slot 8.

Further, the image forming unit 60 is attached to a frame that constitutes a device main body. The frame includes substantially plate-shaped side frames (not shown) provided at both ends in a right-to-left direction of the mechanical unit 3, a bottom plate (not shown) extending in the right-to-left direction so as to connect respective lower ends the side frames, and a top plate (not shown) connecting respective upper ends of the side frames.

2. Image Forming Unit

The image forming unit 60 includes four drum units 61K, 61Y, 61M, and 61C detachably disposed that respectively correspond to black (K), yellow (Y), magenta (M), and cyan (C) in an order from an upstream side in an arrow A direction indicating a carrying direction of a sheet.

The drum units 61K, 61Y, 61M, and 61C are provided with photoconductive bodies 62K, 62Y, 62M, and 62C that rotate in an arrow B direction. Images of the predetermined colors are sequentially transferred onto a sheet, which is conveyed in the arrow A direction while being stuck to a carrying belt 68, by the photoconductive bodies 62K, 62Y, 62M, and 62C and transfer rollers 63K, 63Y, 63M, and 63C rotated in concord with the photoconductive bodies 62K, 62Y, 62M, and 62C, respectively. Thereafter, the images of the predetermined colors on the sheet are thermally fixed with a fixing unit 56. Then, the sheet is discharged by feed rollers 57 to a catch tray 45 provided to the upper case 1.

Meanwhile, the upper case 1 includes four LED units 67K, 67Y, 67M, and 67C provided in positions that correspond to circumferential surfaces of the photoconductive bodies 62K, 62Y, 62M, and 62C of the drum units 61K, 61Y, 61M, and 61C, respectively.

LED heads 65K, 65Y, 65M, and 65C (described below) provided at respective distal ends of the LED units 67K, 67Y, 67M, and 67C are disposed close to the respective circumferential surfaces of the photoconductive bodies 62K, 62Y, 62M, and 62C. Thereby, it is possible to expose the circumferential surfaces of the photoconductive bodies 62K, 62Y, 62M, and 62C. Each of the photoconductive bodies 62K, 62Y, 62M, and 62C is rotated in the arrow B direction and exposed linearly along the right-to-left direction (i.e., main scanning direction) thereof.

It is noted that the drum units 61, photoconductive bodies 62, transfer rollers 63, LED units 67, and LED heads 65 in general and, unless specified otherwise, are configured in the same manner, respectively. If it is required to distinguish each element of the same sort of component from the other elements, each element will be distinguished with a reference character (K), (Y), (M), or (C) representing a corresponding color attached thereto.

3. Feeder Unit

As illustrated in FIG. 1, the feeder unit 70 includes a sheet feed cassette 71 detachably attached to a lowermost portion of the mechanical unit 3 and a pickup roller 72 provided at an upper front portion of the sheet feed cassette 71 so as to feed a sheet to the image forming unit 60. Further, the feeder unit 70 includes a separation roller 73 configured to separate the sheet fed by the pickup roller 72 on a sheet-by-sheet basis while rotating and a separation pad 74.

On a downstream side of the separation roller 73 and separation pad 74 in the carrying direction, a sheet feed roller 33 configured to feed a sheet while rotating is provided. Further, on a downstream side of the sheet feed roller 33 in the carrying direction, a sensor D1 configured to detect whether a sheet passes therethrough is provided. In addition, the pair of registration rollers 35 provided on an inlet port side of the image forming unit 60 is configured to convey a sheet while rotating and perform a registration operation. Further, a sensor D3 configured to detect whether a sheet passes therethrough is provided on a downstream side of the pair of registration rollers 35.

4. Manual Sheet Feed Mechanism

Figure 2:
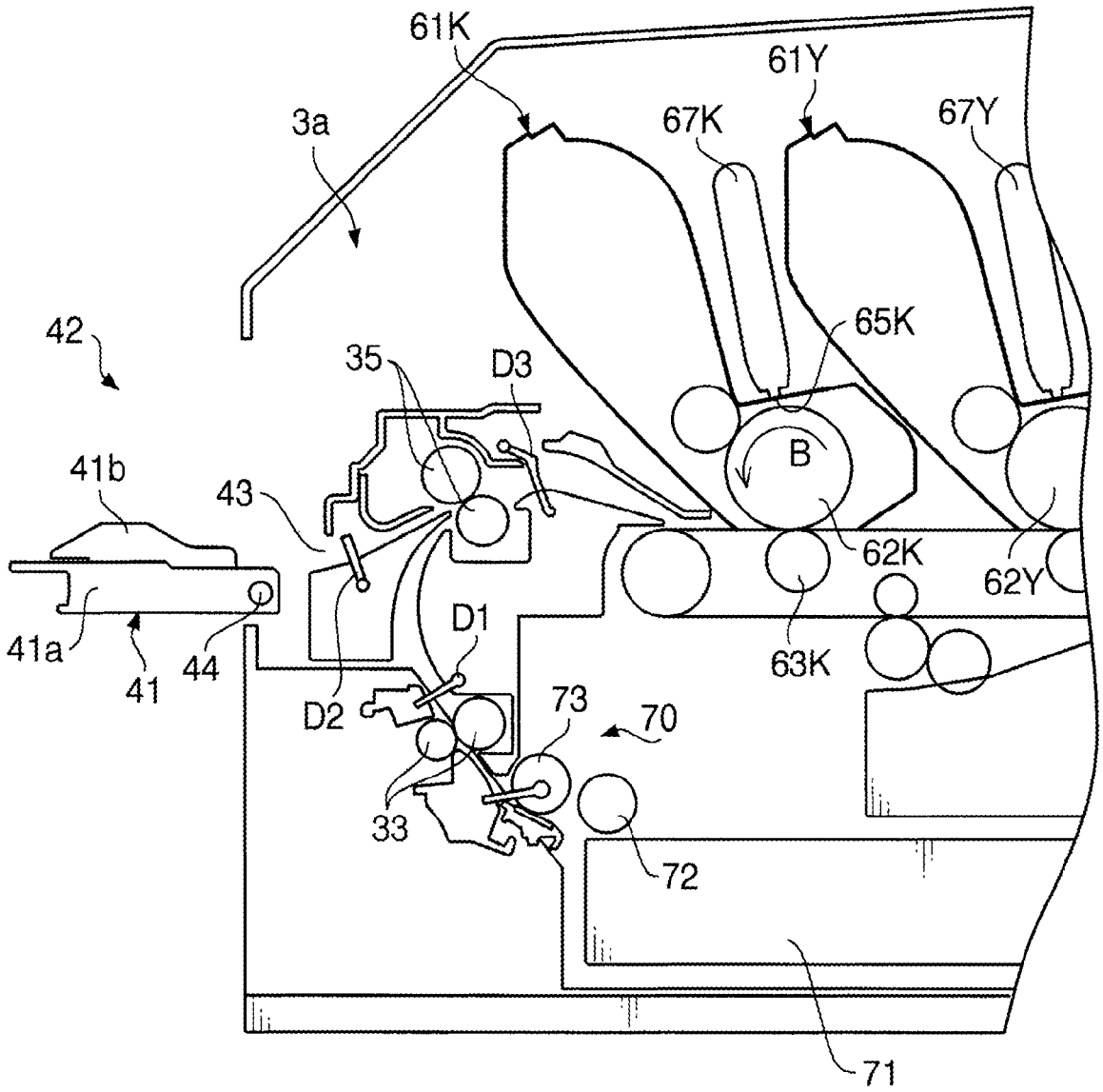
FIG. 2 is an enlarged view schematically showing a part of the LED printer shown in FIG. 1 in the embodiment according to one or more aspects of the present invention.

FIG. 1 shows a state where a manual sheet feed tray 41 is closed. Meanwhile, FIG. 2 is a cross-sectional side view schematically showing a relevant part when the manual sheet feed tray 41 is opened. The LED printer 5 includes a manual sheet feed mechanism 42 configured to convey a sheet fed manually from a front face side of the LED printer 5 to a transferring position. The manual sheet feed mechanism 42 is provided with the manual sheet feed tray 41 and an opening 43 through which a sheet is inserted.

The opening 43 is formed as a rectangular through hole at a front side of the mechanical unit 3. The manual sheet feed tray 41 is provided to cover the opening 43. Specifically, the sheet feed tray 41 is configured with a cover 41*a* as a front wall of the mechanical unit 3 and a tray portion 41*b* configured to be loaded with one or more sheets to be manually fed. As illustrated in FIG. 2, a lower portion of the cover 41*a* is supported rotatably around a cover rotational shaft 44 in an openable and closable manner with respect to the mechanical unit 3. In addition, a sensor D2 configured to detect whether there is a sheet on the tray portion 41*b* is provided on a downstream side of the manual sheet feed tray 41 in the carrying direction.

5. Electrical Configuration of LED Printer

Figure 3:
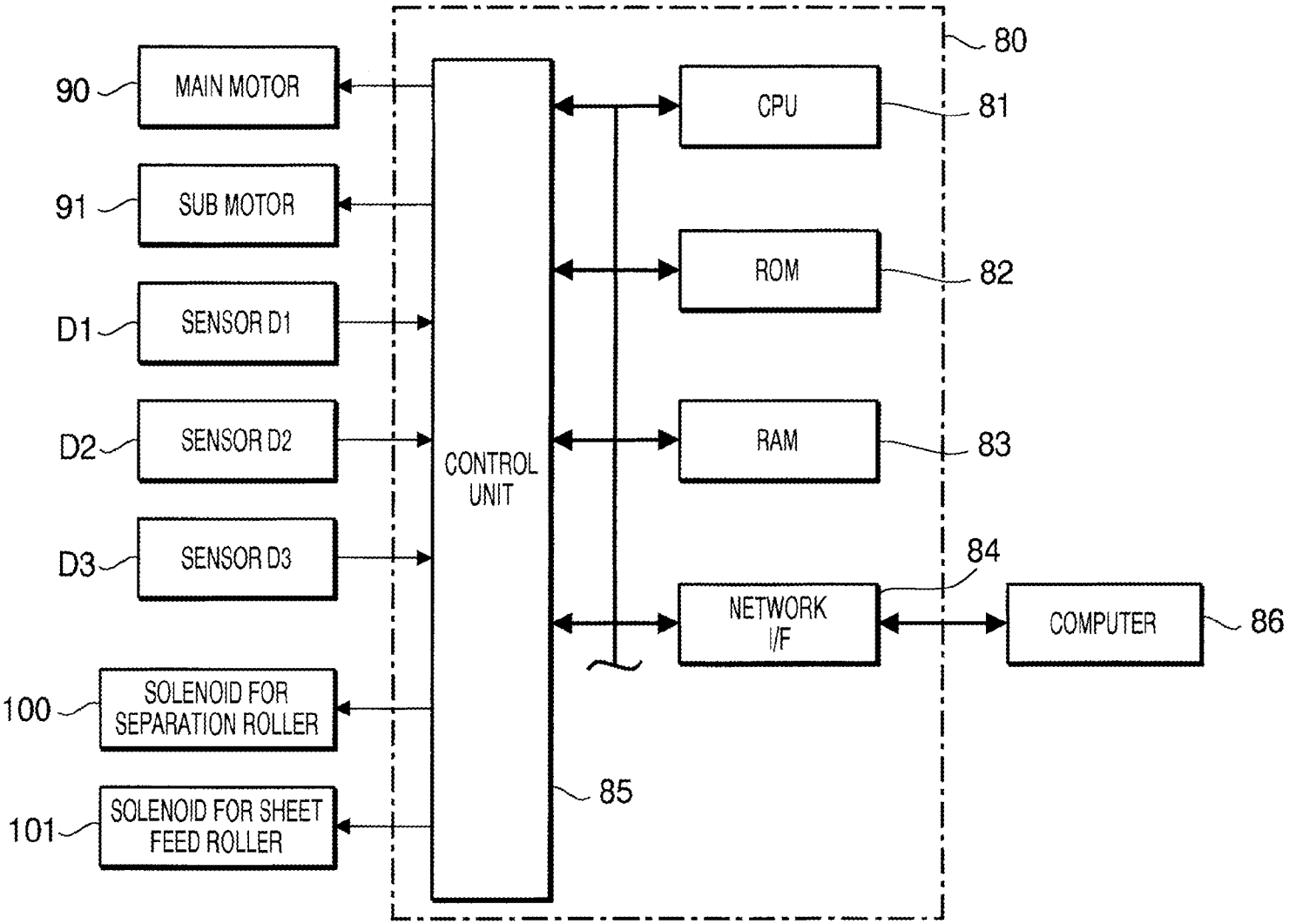
FIG. 3 is a block diagram schematically showing an electrical configuration of the LED printer in the embodiment according to one or more aspects of the present invention.

Next, an electrical configuration of the LED printer 5 will be described. FIG. 3 is a block diagram schematically showing an electrical configuration of the LED printer 5.

The LED printer 5 is provided with a control device 80 that includes a CPU 81, a ROM 82, a RAM 83, a control unit 85, and a network interface 84. Various control programs, various settings, and initial values for controlling the LED printer 5 are stored on the ROM 82. The RAM 83 is employed as a work area into which the various control programs are loaded or a memory area that temporarily stores therein print data.

The CPU 81 controls each constituent element of the laser printer 1 via the control unit 85, while causing the RAM 83 to store thereon processed results, in accordance with a control program read out from the ROM 82.

The network interface 84, which is connected with an external device such as a computer 86, receives a print command or print data transmitted by the computer 86.

The control unit 85 includes an ASIC, and is electrically linked with each constituent element of the LED printer 5 such as a main motor 90, a sub motor 91, the sensor D1, the sensor D2, the sensor D3, a solenoid 100 for the separation roller, a solenoid 101 for the sheet feed roller.

The main motor 90 is connected with the aforementioned separation roller 73 (pickup roller 72), sheet feed roller 33, and photoconductive body 62 via a gear mechanism (not shown), and configured to drive and rotate the separation roller 73 (pickup roller 72), sheet feed roller 33, and photoconductive body 62 in synchronization with each other. Further, the sub motor 91 is configured to drive and rotate the registration rollers 35.

The solenoid 100 for the separation roller is provided as a clutch mechanism between the main motor 90 and the separation roller 73. When the solenoid 100 for the separation roller is set ON, a driving force is transmitted from the main motor 90 to the separation roller 73. Meanwhile, when the solenoid 100 for the separation roller is set OFF, the transmission of the driving force is blocked. Further, the separation roller 73 and the pickup roller 72 are linked via the gear mechanism such that respective circumferential velocities thereof are the same. Therefore, when the solenoid 100 for the separation roller is set ON, the driving force is transmitted from the main motor 90 to the pickup roller 72 as well. Meanwhile, when the solenoid 100 for the separation roller is set OFF, the transmission of the driving force is blocked.

Additionally, the solenoid 101 for the sheet feed roller is provided as a clutch mechanism between the main motor 90 and the sheet feed roller 33. When the solenoid 101 for the sheet feed roller is set ON, the driving force is transmitted from the main motor 90 to the sheet feed roller 33. Meanwhile, when the solenoid 101 for the sheet feed roller is set OFF, the transmission of the driving force is blocked.

6. Operation of Paper fed from Sheet Feed Cassette in Printing

A sheet fed from the sheet feed cassette 71 is detected by the sensor D1 when a leading edge thereof passes through the pickup roller 72, the separation roller 73, and the sheet feed roller 33. When the leading edge of the sheet is detected by the sensor D1, the transmission of the driving force to the separation roller 73 (and the pickup roller 72) is blocked by the solenoid 100 for the separation roller, and the separation roller 73 is rotated by the sheet being conveyed. Thereafter, the sheet is conveyed by rotation of the sheet feed roller 33 to a downstream side in the carrying direction.

Additionally, when the leading edge of the sheet being conveyed is detected by the sensor D1, the rotations of the registration rollers 35 are stopped with the leading edge of the sheet contacting the registration rollers 35 stopped. In the registration operation here, skew correction of the sheet is executed. Thereafter, the registration rollers 35 are driven again, and the leading edge of the sheet is carried to the image forming unit 60. It is noted that, when the leading edge of the sheet passing through the registration rollers 35 is detected by the sensor D3, exposure operations by the LED units 67 are started. Thereafter, the sheet is conveyed by the carrying belt 68, and four sorts of color images (black, yellow, magenta, and cyan) are sequentially formed.

7. Operation of Sheet Fed Manually in Printing

A sheet fed from the manual sheet feed tray 41 is pushed from the opening 43 by a user to a position where the sheet establishes contact with the registration rollers 35, and placed on the tray portion 41*b* of the manual sheet feed tray 41. Thereby, existence of the sheet is detected by the sensor D2. At this time, the registration rollers 35 is in a stopped state where the transmission of the driving force from the sub motor 91 is blocked, and the skew correction of the sheet is executed with the registration rollers 35 contacting the leading edge of the sheet.

It is noted that, when a predetermined time period elapses after the sheet is detected by the sensor D2, the registration rollers 35 are rotated, and the sheet is conveyed to the image forming unit 60.

In addition, when the sheet is fed from the manual sheet feed tray 41, the separation roller 73 (and the pickup roller 72) and the sheet feed roller 33 are in a state where the transmission of the driving force thereto is blocked by the solenoid 100 for the separation roller and the solenoid 101 for the sheet feed roller, respectively.

A carrying speed of the LED printer 5 in the present embodiment is adopted to be lower on a further downstream side in the carrying direction. Specifically, when a sheet is conveyed from the sheet feed cassette 71, each carrying element such as the sheet feed roller 33, the registration rollers 35, and the carrying belt 68 is adopted such that the circumferential velocity thereof is higher in an order of the sheet feed roller 33, the registration rollers 35, and the carrying belt 68. Namely, when the circumferential velocities of the sheet feed roller 33, the registration rollers 35, and the carrying belt 68 are represented by $\alpha 1$, $\beta 1$, and $\gamma 1$, respectively, a relationship of $\alpha 1 > \beta 1 > \gamma 1$ is established.

The sheet fed from the sheet feed cassette 71 is always in a state pushed at the circumferential velocity $\alpha 1$ by the sheet feed roller 33 toward the downstream side in the carrying direction. Accordingly, the sheet fed by the sheet feed roller 33 is conveyed while slightly slipping between the registration rollers 35. Namely, the sheet is conveyed at a velocity higher than the actual circumferential velocity $\beta 1$ of the registration rollers 35.

Thus, a carrying speed for the sheet that has been made higher by the sheet feed roller 33 is represented by β2.

In other words, the carrying speed by the registration rollers 35 for the sheet fed from the sheet feed cassette 71 is actually conveyed not at the velocity β1 but at the velocity β2.

Meanwhile, the sheet fed from the manual sheet feed tray 41 is conveyed to the image forming unit 60 by the registration rollers 35 that are rotated after the sheet is placed on the tray portion 41*b* of the manual sheet feed tray 41. The sheet is conveyed due to the rotation of the registration rollers 35 after being placed on the tray portion 41*b* of the manual sheet feed tray 41, and therefore the circumferential velocity β1 of the registration rollers 35 corresponds to the carrying speed for the sheet. Namely, the carrying speed by the registration rollers 35 is β2 for the sheet fed from the sheet feed cassette 71, and β1 for the sheet fed from the manual sheet feed tray 41 (β2<β1).

When a sheet is fed from the manual sheet feed tray 41, by setting the carrying speed by (circumferential velocity of) the registration rollers 35 to β2, the carrying speed for the sheet fed from the manual sheet feed tray 41 can be made identical to the carrying speed for the sheet fed from the sheet feed cassette 71. Thereby, carrying speeds in carrying the sheet to the image forming unit 60 are the same between the sheet fed from the manual sheet feed tray 41 and the sheet fed from the sheet feed cassette 71. Thus, it is possible to avoid positional difference between images formed on the sheet fed from the manual sheet feed tray 41 and the sheet fed from the sheet feed cassette 71. Further, in the LED printer 5 configured to sequentially form four sorts of color images (yellow, magenta, cyan, and black) in the present embodiment, it is possible to prevent positional deviations that might be caused among the respective color images.

Figure 4:
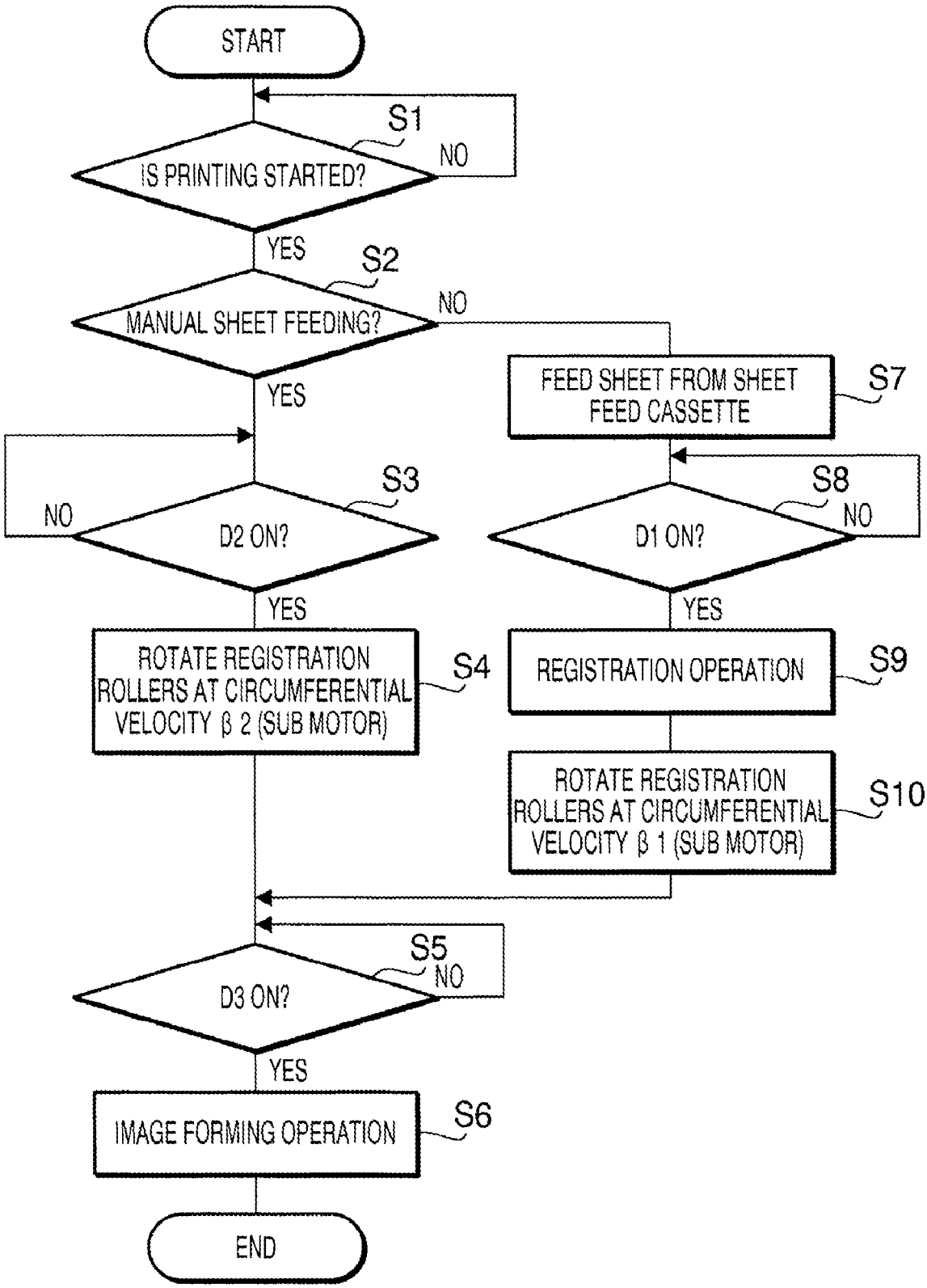
FIG. 4 is a flowchart showing operations to be executed by the LED printer in the embodiment according to one or more aspects of the present invention.
Figure 5:
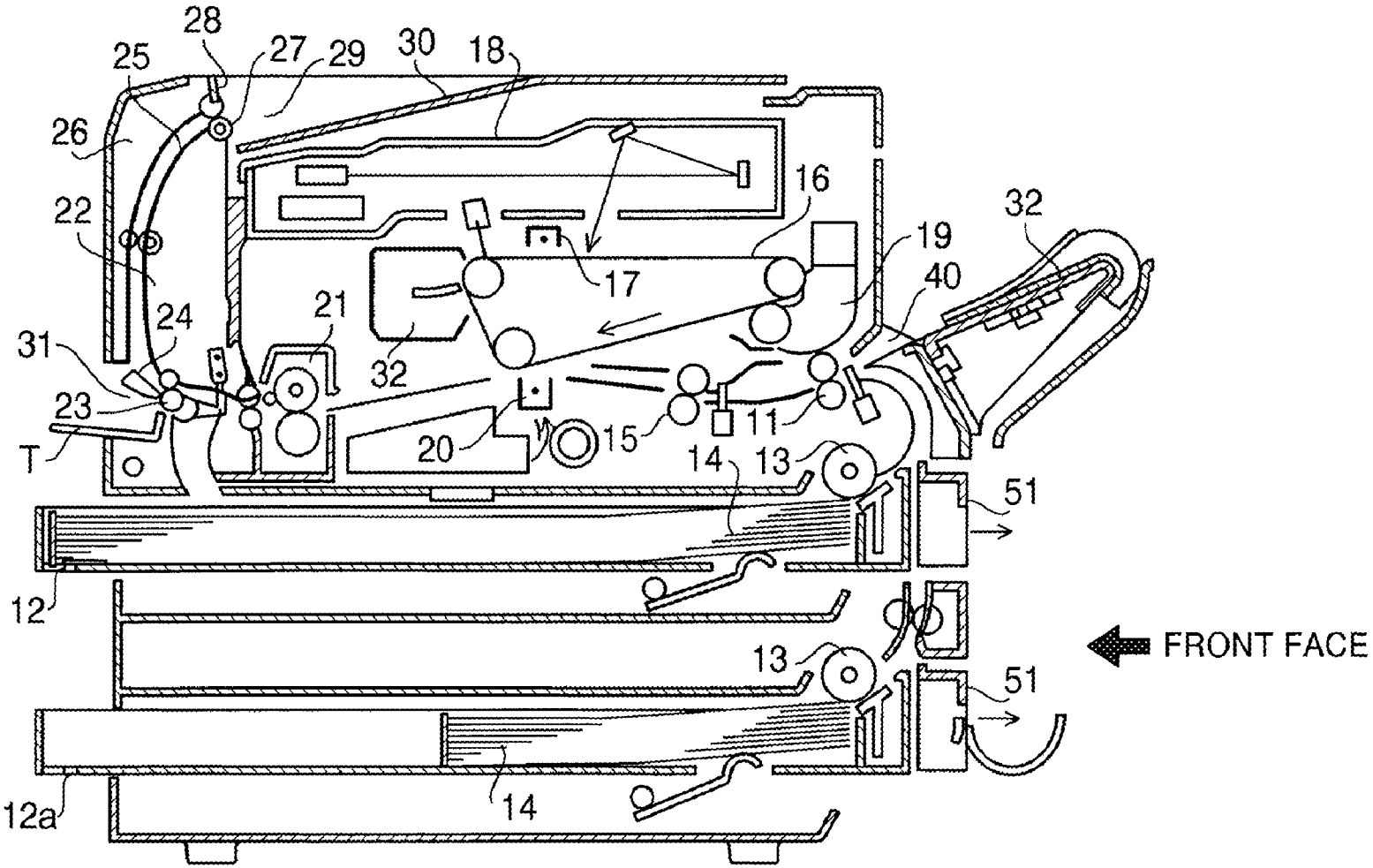
FIG. 5 PRIOR ART
FIG. 5 is a cross-sectional side view schematically showing a known image forming device.

FIG. 4 is a flowchart showing operations to be executed by the LED printer 5 in the present embodiment. Firstly, it is determined in S1 whether a button to start printing is pressed (S1). When the button to start printing is pressed (S1: Yes), the present process goes to S2, in which it is determined whether a sheet is fed from the manual sheet feed tray 41 (S2).

When it is determined that a sheet is fed from the manual sheet feed tray 41 (S2: Yes), it is determined whether the sensor D2 is put into an ON state where a sheet is placed on the tray portion 41*b* (S3). When the sensor D2 is put into the ON state (S3: Yes), the present process goes to S4, in which the number of revolutions of the sub motor 91 is switched to set the circumferential velocity of the registration rollers 35 to 02 (S4). Subsequently, it is determined whether the sensor D3 is put into an ON state where the sheet is carried by the registration rollers 35 to the image forming unit 60 (S5). When the sensor D3 is put into the ON state (S5: Yes), the present process goes to S6, in which an image forming operation is performed (S6).

Meanwhile, in the step S2, when it is determined that a sheet is not fed from the manual sheet feed tray 41 (S2: No), the present process goes to S7, in which a sheet is fed from the sheet feed cassette 71 (S7). Subsequently, it is determined whether the sensor D1 is put into an ON state where the sheet is fed to the registration rollers 35 by the sheet feed roller 33 (S8). When the sensor D1 is put into the ON state (S8: Yes), the registration operation is performed (S9). Thereafter, in S10, the number of revolutions of the sub motor 91 is switched to set the circumferential velocity of the registration rollers 35 to β1 (S10). Next, the process goes to the aforementioned step S5.

In the control device 80 of the present embodiment configured as above, the circumferential velocity of the registrations rollers 35 is controlled depending on whether the sheet is fed from the sheet feed cassette 71 or from the manual sheet feed tray 41. Specifically, when the sheet is fed from the sheet feed cassette 71, the registration rollers 35 are driven at the normal circumferential velocity β1. Meanwhile, when the sheet is fed from the manual sheet feed tray 41, the registration rollers 35 are driven at the circumferential velocity β2 a little higher than β1. Namely, the LED printer 5 of the present embodiment is configured such that velocity ratios of the circumferential velocity of the carrying belt 68 to the registration rollers 35 are different between a case where the sheet is fed from the sheet feed cassette 71 and a case where the sheet is fed from the manual sheet feed tray 41.

In the present embodiment, a technique has been described, in which the circumferential velocity of the registration rollers 35 is switched between the case where the sheet is fed from the sheet feed cassette 71 and the case where the sheet is fed from the manual sheet feed tray 41. However, the present invention is not limited to the aforementioned embodiment. For example, two or more sheet feed cassettes 71 may be provided. Further, two or more sheet feed rollers 33 may be provided. In any cases, by changing the circumferential velocity of the registration rollers 35 as required, carrying speeds to feed a sheet to the image forming unit 60 are adopted to be the same, and thus it is possible to prevent positional difference between respective images formed on sheets fed in different ways and positional deviations among respective images of the four colors formed on a sheet.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

What is claimed is:

1. An image forming device, comprising:

a plurality of medium feed units configured to feed a recording medium on respective carrying routes, the plurality of medium feed units comprising:

a first medium feed unit configured to feed the recording medium supplied from a manual feed port on a first carrying route; and a second medium feed unit configured to pick up the recording medium from a medium receptacle and feed the picked-up recording medium on a second carrying route;

an image forming unit configured to form an image on the recording medium fed from one of the plurality of medium feed units;

a first roller provided on a common route of the first and second carrying routes, the first roller being configured to rotate at a first circumferential velocity and carry, to the image forming unit, the recording medium fed from one of the plurality of medium feed units;

a carrying belt disposed downstream relative to the first roller on the common route; and a control unit configured to control the first circumferential velocity of the first roller depending on from which of the plurality of medium feed units the recording medium is fed, wherein the image forming device further comprises a second roller provided at an upstream side of the first roller on the second carrying route, the second roller being configured to rotate at a second circumferential velocity higher than the first circumferential velocity, wherein the control unit controls the first circumferential velocity of the first roller to be higher when the recording medium is fed from the first medium feed unit than when the recording medium is fed from the second medium feed unit, such that a carrying speed of the recording medium through the first roller is at a single predetermined value when the recording medium is fed from the first medium feed unit or from the second medium feed unit, the first circumferential velocity being controlled to be equivalent to the single predetermined value, and lower than the second circumferential velocity, when the recording medium is fed from the first medium feed unit, the first circumferential velocity being controlled to be lower than the single predetermined value, and the second circumferential velocity, when the recording medium is fed from the second medium feed unit.

2. The image forming device according to claim 1, wherein the image forming unit includes:

a plurality of photoconductive bodies corresponding to respective different colors;

a plurality of transfer rollers configured to rotate in concord with the plurality of photoconductive bodies, respectively; and a carrying belt configured to travel in concord with the plurality of photoconductive bodies and carry the recoding medium thereon, and wherein the image forming unit transfers images of the different colors, in a sequentially overlaid manner, onto the recording medium being carried on the carrying belt by using the plurality of photoconductive bodies and the plurality of transfer rollers.

3. The image forming device according to claim 1, wherein the control unit includes a determining unit configured to determine whether the recording medium is fed from the first medium feed unit.

4. The image forming device according to claim 1, further comprising a detector configured to determine whether the recording medium is fed from the first medium feed unit.

5. The image forming device according to claim 1, wherein both the first medium feed unit and the second medium feed unit are configured to feed the recording medium such that the image forming unit forms the image on a first side of the recording medium.

6. The image forming device according to claim 1, wherein the control unit is configured to control the first circumferential velocity of the first roller within a velocity range higher than a circumferential velocity of the carrying belt and lower than the second circumferential velocity of the second roller.

7. An image forming device, comprising:

a plurality of medium feed units configured to feed a recording medium on respective carrying routes, the plurality of medium feed units comprising:

a first medium feed unit including a manual sheet feed tray, wherein the first medium feed unit is configured to feed the recording medium, supplied from the manual sheet feed tray, on a first carrying route; and a second medium feed unit, including a sheet feed cassette, wherein the second medium feed unit is configured to pick up the recording medium from the sheet feed cassette and feed the picked-up recording medium on a second carrying route;

an image forming unit configured to form an image on the recording medium fed from one of the plurality of medium feed units;

a first roller provided on a common route of the carrying routes, the first roller being configured to rotate at a first circumferential velocity and carry, to the image forming unit, the recording medium fed from one of the plurality of medium feed units;

a carrying belt disposed downstream relative to the first roller on the common route; and a control unit configured to control the first circumferential velocity of the first roller depending on from which of the plurality of medium feed units the recording medium is fed, wherein the image forming device further comprises a second roller provided at an upstream side of the first roller on the second carrying route, the second roller being configured to rotate at a second circumferential velocity higher than the first circumferential velocity, and wherein the control unit controls the first circumferential velocity of the first roller to be higher when the recording medium is fed from the first medium feed unit than when the recording medium is fed from the second medium feed unit, such that the recording medium fed from the first medium unit is carried through the first roller at a same speed as when the recording medium fed from the second medium feed unit is carried through the first roller.

8. The image forming device according to claim 7, wherein the control unit is configured to control the first circumferential velocity of the first roller within a velocity range higher than a circumferential velocity of the carrying belt and lower than the second circumferential velocity of the second roller.

9. The image forming device according to claim 7, further comprising:

a plurality of photoconductive bodies configured to carry thereon developer images of respective colors; and a plurality of transfer rollers disposed to face the plurality of photoconductive bodies across the carrying belt, respectively;

wherein the image forming unit is configured to form a color image on the recording medium by sequentially transferring the developer images carried on the plurality of photoconductive bodies onto the recording medium being carried on the carrying belt in a superimposed manner in respective image forming positions between the plurality of photoconductive bodies and the plurality of transfer rollers; and wherein a circumferential velocity of the carrying belt is constant.

10. An image forming device comprising:

an image forming unit configured to form an image on a recording sheet:

a sheet cassette configured to feed the recording sheet to the image forming unit, the sheet cassette accommodating a plurality of sheets;

a manual feed tray configured to feed the recording sheet to the image forming unit, the manual feed tray being adapted such that a sheet is manually placed thereon;

a first roller disposed on a carrying route from the sheet cassette to the image forming unit, the first roller being configured to rotate and feed the recording sheet; and a second roller disposed downstream relative to the first roller on the carrying route from the sheet cassette to the image forming unit, the second roller being configured to rotate and feed the recording sheet to the image forming unit, wherein the recording sheet fed from the manual feed tray merges onto a route between the first roller and the second roller, and is conveyed to the image forming unit by the second roller rotating, wherein the first roller is configured to rotate at a circumferential velocity higher than a circumferential velocity of the second roller, and wherein the second roller is controlled to, when the recording sheet is fed from the manual feed tray, rotate at a circumferential velocity higher than when the recording sheet is fed from the sheet cassette, such that the recording medium fed from the manual feed tray is carried through the first roller at a same speed as when the recording medium fed from the sheet cassette is carried through the first roller.

11. The image forming device according to claim 10, further comprising:

a carrying belt disposed downstream relative to the second roller on the carrying route;

a plurality of photoconductive bodies configured to carry thereon developer images of respective colors; and a plurality of transfer rollers disposed to face the plurality of photoconductive bodies across the carrying belt, respectively;

wherein the image forming unit is configured to form a color image on the recording sheet by sequentially transferring the developer images carried on the plurality of photoconductive bodies onto the recording sheet being carried on the carrying belt in a superimposed manner in respective image forming positions between the plurality of photoconductive bodies and the plurality of transfer rollers; and wherein a circumferential velocity of the carrying belt is constant.

* * * * *

UNITED STATES PATENT AND TRADEMARK OFFICE

CERTIFICATE OF CORRECTION

PATENT NO. : 8,320,815 B2
APPLICATION NO. : 12/324173
DATED : November 27, 2012
INVENTOR(S) : Hidetoshi Yano It is certified that error appears in the above-identified patent and that said Letters Patent is hereby corrected as shown below:

Title Page, Item (75) Inventors:

Please remove "Sachiko Yano" from the listed inventors. Sachiko Yano is a Legal Representative.

Signed and Sealed this
Nineteenth Day of March, 2013

Teresa Stanek Rea
*Acting Director of the United States Patent and Trademark Office*